US006119468A

United States Patent [19]

Seok

[11] Patent Number: 6,119,468

[45] Date of Patent: Sep. 19, 2000

[54] UNIFORM COOLING APPARATUS FOR REFRIGERATOR AND CONTROL METHOD THEREOF

[75] Inventor: Jin-Oh Seok, Kwangju, Rep. of Korea

[73] Assignee: Samsung Electronics Co., Ltd., Rep. of Korea

[21] Appl. No.: 09/357,377

[22] Filed: Jul. 20, 1999

[30] Foreign Application Priority Data

Jul. 30, 1998 [KR] Rep. of Korea ..... 98-30849

[51] Int. Cl.[7] ..... F25D 17/06

[52] U.S. Cl. ..... 62/89; 62/186; 62/414

[58] Field of Search ..... 62/186, 414, 419, 62/426, 89

[56] References Cited

U.S. PATENT DOCUMENTS

| | | | |
|---|---|---|---|
| 3,005,321 | 10/1961 | Devery | 62/186 |
| 3,026,688 | 3/1962 | O'Connell | 62/419 |
| 3,027,732 | 4/1962 | Mann et al. | 62/408 |
| 3,633,375 | 1/1972 | McLean | 62/186 |
| 5,220,806 | 6/1993 | Jaster et al. | 62/186 |
| 5,816,061 | 10/1998 | Lee et al. | 62/187 |
| 5,826,437 | 10/1998 | Kim | 62/186 |

*Primary Examiner*—William E. Tapolcai
*Attorney, Agent, or Firm*—Larson & Taylor, PLC

[57] ABSTRACT

A uniform cooling apparatus for a refrigerator and a control method thereof install a plurality of temperature sensors into a refrigerating compartment, mount an air circulation fan in addition to a prior refrigerating compartment fan into the refrigerating compartment, and thus obtain a uniform cooling effect by minimizing a refrigerating compartment temperature deviation. The uniform cooling apparatus includes: a plurality of temperature sensors which are mounted to at least two positions inside of the refrigerating compartment; and an air circulation fan which is additionally mounted to the refrigerating compartment, is turned on or off according to a deviation among temperatures sensed by the plurality of temperature sensors, and makes a uniform cool air in the refrigerating compartment. The uniform cooling control method for the refrigerator comprising the steps of: (a) sensing a refrigerating compartment temperature by using the plurality of temperature sensors; (b) calculating a temperature deviation among the refrigerating compartment temperatures sensed in the step (a); and (c) driving the air circulation fan if the temperature deviation is higher than a predetermined temperature deviation, and uniformly cooling the refrigerating compartment.

6 Claims, 5 Drawing Sheets

UNIFORM COOLING APPARATUS FOR REFRIGERATOR AND CONTROL METHOD THEREOF

BACKGROUND OF THE INVENTION (1) Field of the Invention

The present invention relates to a uniform cooling apparatus for a refrigerator and a control method thereof. More particularly, it relates to a uniform cooling apparatus for a refrigerator and a control method thereof, which install a plurality of temperature sensors into a refrigerating compartment, mount an air circulation fan in addition to a prior refrigerating compartment fan into the refrigerating compartment, and thus obtain a uniform cooling effect by minimizing a refrigerating compartment temperature deviation.

(2) Description of the Prior Art

The following description relates to the prior art.

Firstly, U.S. Pat. No. 5,784,895 discloses a refrigerator having an air curtain fan for making an air curtain to block the invasion of the surrounding air. This refrigerator does not have a plurality of temperature sensors and another refrigerating compartment fan excepting the air curtain fan. The air curtain fan is driven when the refrigerating compartment door is opened, and is not related to a uniform cooling effect.

A conventional refrigerator will be described with reference to FIG. 1. FIG. 1 illustrates a cross-sectional view of a conventional refrigerator.

Referring to FIG. 1, a conventional refrigerator includes a main body 1, a compressor 30, a freezing compartment 10, a refrigerating compartment 20, a freezing compartment door 11, a refrigerating compartment door 21, a freezing compartment evaporator 13, a freezing compartment fan 14, a refrigerating compartment evaporator 23, a refrigerating compartment fan 24, a refrigerating compartment temperature sensor 27, and a freezing compartment temperature sensor 15.

In addition, a reference numeral 12 is a rear wall of the freezing compartment 20, and a reference numeral 25 is a duct 25 which separates the refrigerating compartment fan 24 and the refrigerating compartment evaporator 23 from a storage space of the refrigerating compartment 20, and induces a cool air flow. The reference numeral 26 is a cool air discharge hole 26 for discharging a cool air into the refrigerating compartment 26.

The above refrigerator will be operated as follows.

In a cooling operation of the refrigerating compartment 20, if a refrigerating compartment temperature sensed by the refrigerating compartment temperature sensor 27 is higher than the refrigerating compartment set temperature, a compressor 30 and a refrigerating compartment fan 24 are driven to generate a cool air. The generated cool air passes through the refrigerating compartment fan 24, and is then provided into the inner space of the refrigerating compartment 20 via a discharge hole 26 provided on the duct 25. During cooling the refrigerating compartment 20, if the refrigerating compartment temperature is higher than the refrigerating compartment set temperature, the compressor 30 and the refrigerating compartment fan 24 are stopped to prevent overcooling.

However, the conventional refrigerator attaches only one temperature sensor 27 into the refrigerating compartment 20, does not effectively control the inner temperature of the refrigerating compartment 20 having a wide inner space.

That is, the conventional refrigerator stops a cooling operation of the refrigerating compartment in case that the refrigerating compartment temperature sensed by the temperature sensor 27 is lower than the refrigerating compartment set temperature. At this time, since the refrigerating compartment temperature is sensed in front of the discharge hole 26, the refrigerating compartment temperature is generally lower than other refrigerating compartment temperature sensed at another portion.

However, although a refrigerating compartment temperature sensed at another portion excepting the vicinity of the refrigerating compartment temperature sensor 27 is not reached to the refrigerating compartment set temperature, the cooling operation of the refrigerating compartment stops on the basis of only one temperature sensed at one position, therefore the inside of the refrigerating compartment is not uniformly cooled. As a result, in case that the food far positioned from the cool air is stored for a long time, the food becomes quickly damaged as compared with another food nearby positioned the cool air.

SUMMARY OF THE INVENTION

Accordingly, the present invention is directed to a uniform cooling apparatus for a refrigerator and a control method thereof that substantially obviate one or more of the problems due to limitations and disadvantages of the related art.

It is an objective of the present invention to provide a uniform cooling apparatus for a refrigerator and a control method thereof, which install a plurality of temperature sensors into a refrigerating compartment, mount an air circulation fan in addition to a prior refrigerating compartment fan into the refrigerating compartment, and thus obtain a uniform cooling effect by minimizing a refrigerating compartment temperature deviation.

It is another objective of the present invention to provide a uniform cooling apparatus for a refrigerator and a control method thereof, which drive an air circulation fan if there is a predetermined temperature deviation in temperatures sensed by the plurality of temperature sensors, thereby uniformly cooling the inner space of a refrigerating compartment.

It is still another objective of the present invention to provide a uniform cooling apparatus for a refrigerator and a control method thereof, which turn off an air circulation fan if a door of the refrigerating compartment is opened while driving the air circulation fan.

To achieve the above objectives, in a refrigerator which includes: a refrigerating compartment, a compressor for compressing a refrigerant, a refrigerating compartment evaporator for generating a cool air, a refrigerating compartment fan for discharging the cool air into the refrigerating compartment, a door of the refrigerating compartment, and a door opening/closing sensor for sensing an opening/closing of the door, a uniform cooling apparatus for a refrigerator according to the present invention includes:

a plurality of temperature sensors which are mounted to at least two positions inside of the refrigerating compartment in order to sense a temperature deviation of the refrigerating compartment; and an air circulation fan which is additionally mounted to the refrigerating compartment, is separated from the refrigerating compartment fan, is turned on if a deviation among temperatures sensed by the plurality of temperature sensors is higher than a predetermined temperature deviation, is turned off if a deviation among temperatures sensed by the plurality of temperature sensors is lower than the predetermined temperature deviation, and makes a uniform cool air in the refrigerating compartment.

In a refrigerator which includes: a refrigerating compartment, a compressor for compressing a refrigerant, a refrigerating compartment evaporator for generating a cool air, a refrigerating compartment fan for discharging the cool air into the refrigerating compartment, a plurality of temperature sensors for sensing a plurality of refrigerating compartment temperatures, an air circulation fan which is mounted to a rear wall of the refrigerating compartment, and circulates a cool air, a door of the refrigerating compartment, and a door opening/closing sensor for sensing an opening/closing of the door, a uniform cooling control method for the refrigerator includes the steps of:

(a) sensing a refrigerating compartment temperature by using the plurality of temperature sensors;

(b) calculating a temperature deviation among the refrigerating compartment temperatures sensed in the step (a); and (c) driving the air circulation fan if the temperature deviation is higher than a predetermined temperature deviation, and uniformly cooling the refrigerating compartment.

The uniform cooling control method for the refrigerator further includes the step of turning off the air circulation fan if the refrigerating compartment door is opened during the step (c).

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

The preferred embodiments of the present invention will now be described in detail with reference to the accompanying drawings.

Figure 1:
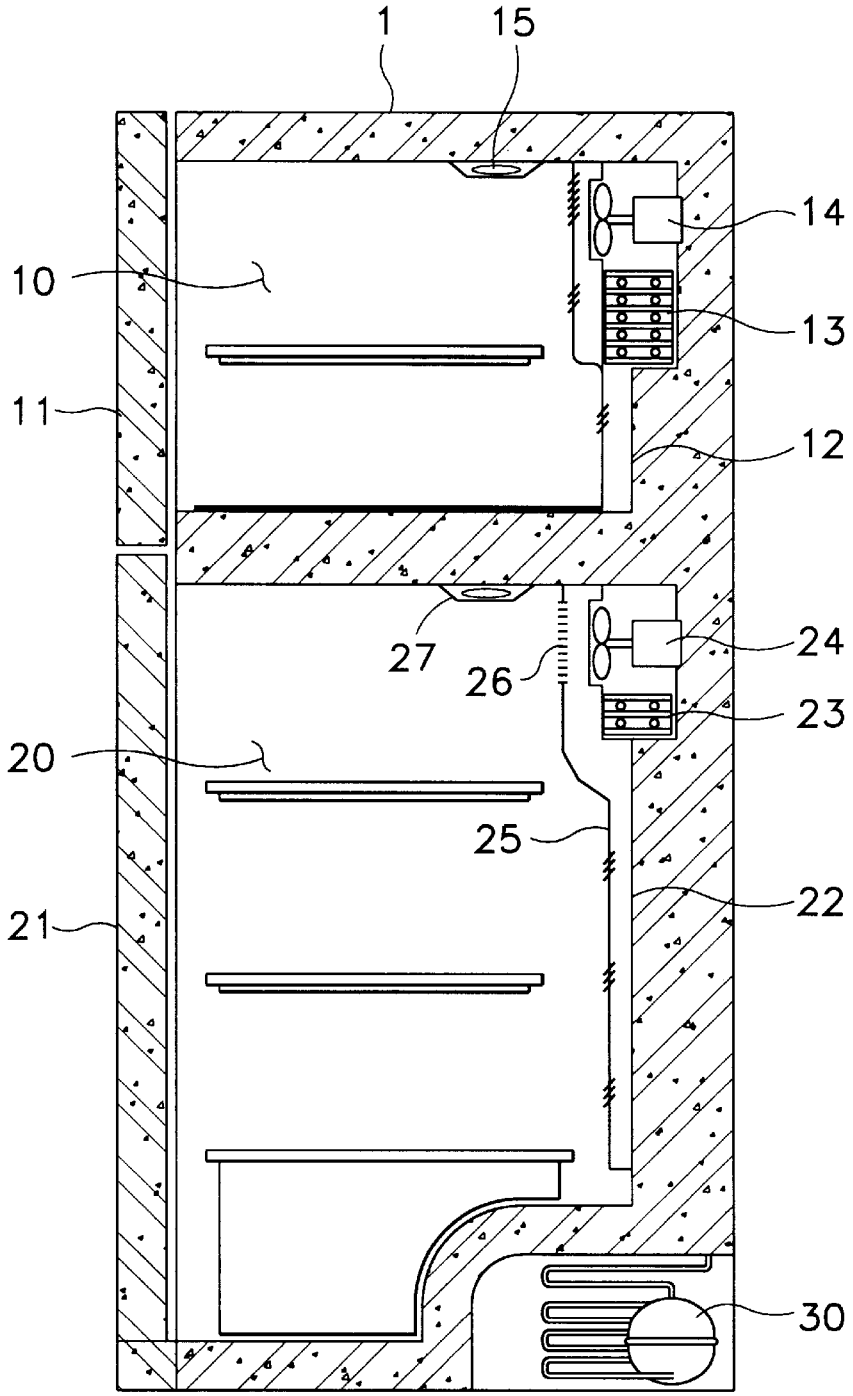
FIG. 1 (PRIOR ART)
FIG. 1 shows an internal structure of a prior refrigerator.
Figure 2:
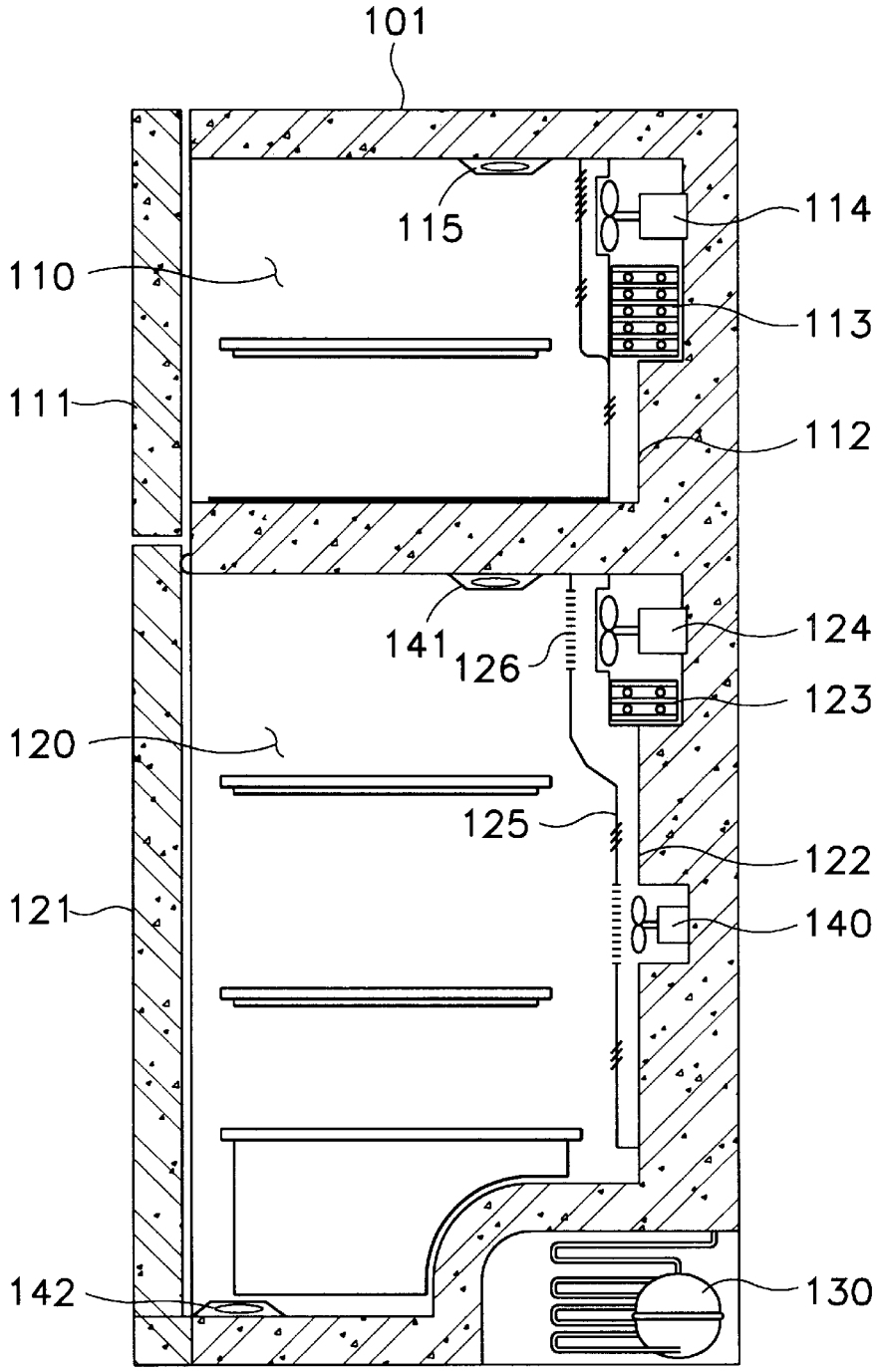
FIG. 2 shows an internal structure of a refrigerator according to the present invention.

FIG. 2 shows an internal structure of a refrigerator according to the present invention.

Referring to FIG. 2, a refrigerator according to the present invention includes a main body 101, a compressor 130, a freezing compartment 110, a refrigerating compartment 120, a freezing compartment door 111, a refrigerating compartment door 121, a freezing compartment evaporator 113, a freezing compartment fan 114, a refrigerating compartment evaporator 123, a refrigerating compartment fan 124, and a freezing compartment temperature sensor 115.

The refrigerator further includes: a first temperature sensor 141 for sensing an upper part temperature of the refrigerating compartment 120; a second temperature sensor 142 for sensing a lower part temperature of the refrigerating compartment 120; and an air circulation fan 140 which is mounted to the center part of the rear wall 122 of the refrigerating compartment 120, and vertically and horizontally ventilates a cool air from the refrigerating compartment evaporator 123.

In addition, a reference numeral 112 is a rear wall of the freezing compartment 120, and a reference numeral 125 is a duct which separates the refrigerating compartment fan 124 and the refrigerating compartment evaporator 123 from a storage space of the refrigerating compartment 120, and induces a cool air flow. The reference numeral 126 is a cool air discharge hole 126 for discharging a cool air into the refrigerating compartment 126.

Here, excepting the upper and lower parts of the refrigerating compartment 120, the first and second temperature sensors 141 and 142 can be installed to various portions, e.g., to discharge hole and intake hole of a cool air, a near part and a far part from the refrigerating compartment fan 124, or inner part and the vicinity of the door 121 of the refrigerating compartment 120, etc.

Figure 3:
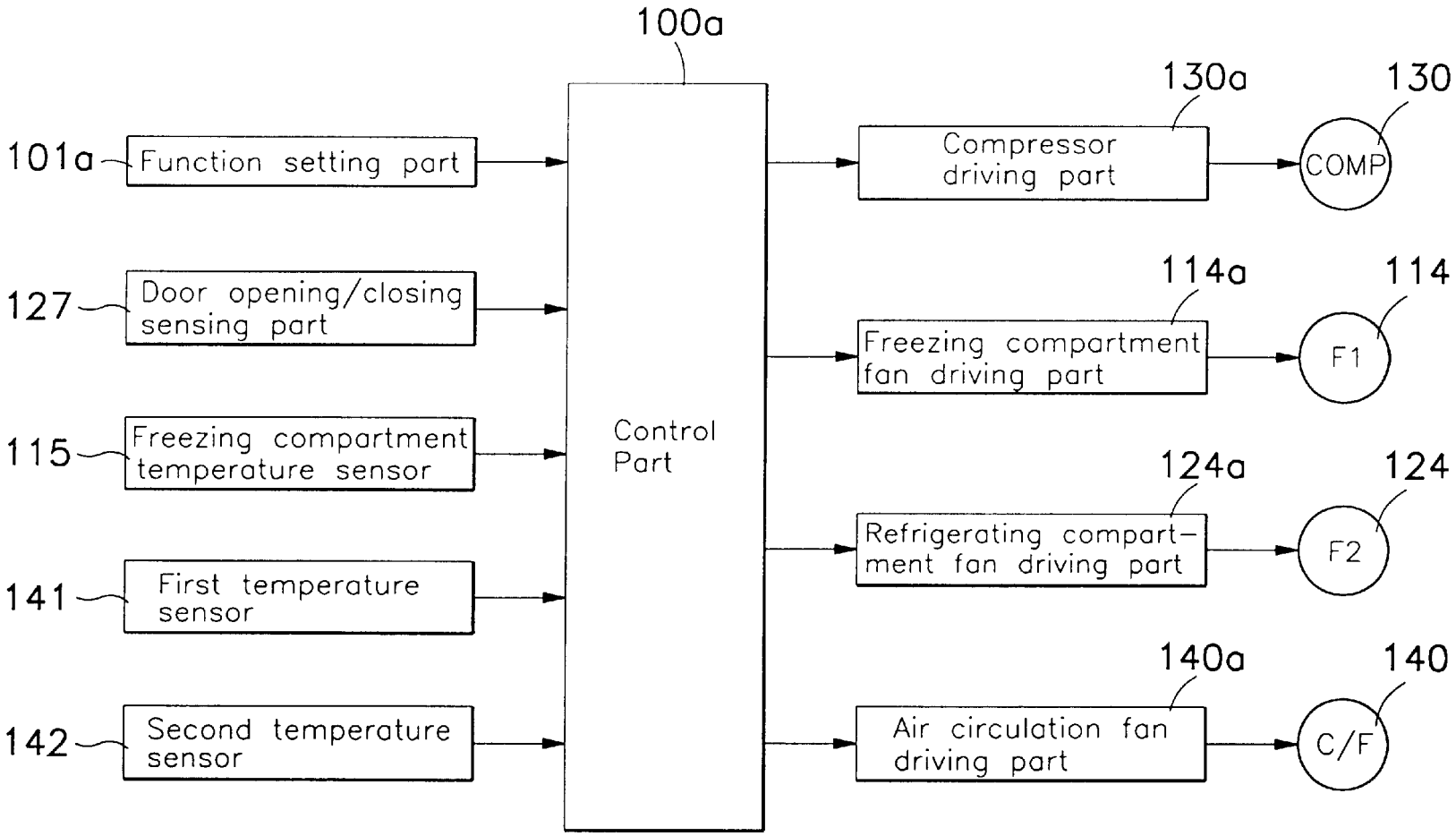
FIG. 3 shows a block diagram of a uniform cooling apparatus of a refrigerator according to the present invention.

FIG. 3 shows a block diagram of a uniform cooling apparatus of a refrigerator according to the present invention.

Referring to FIG. 3, in addition to the elements of FIG. 2, the uniform cooling apparatus further includes:

a control part 100*a* which has various programs such as a freezing operation, a refrigerating operation and a defrosting operation, and controls a cooling temperature of the freezing compartment 110 and the refrigerating compartment 120;

a function setting part 101*a* for inputting a refrigerator operation mode to the control part 100*a;* a door opening/closing sensing part 127 for sensing an opening or closing of the door 121 of the refrigerating compartment 120;

a compressor driving part 130*a* for transmitting a driving signal to a compressor 130;

a freezing compartment fan driving part 114*a* for transmitting a driving signal to a freezing compartment fan 114;

a refrigerating compartment fan driving part 124*a* for transmitting a driving signal to a refrigerating compartment fan 124; and an air circulation fan driving part 140*a* for transmitting a driving signal to an air circulation fan 140.

Operations of the uniform cooling apparatus will now be described with reference to FIG. 4.

Figure 4:
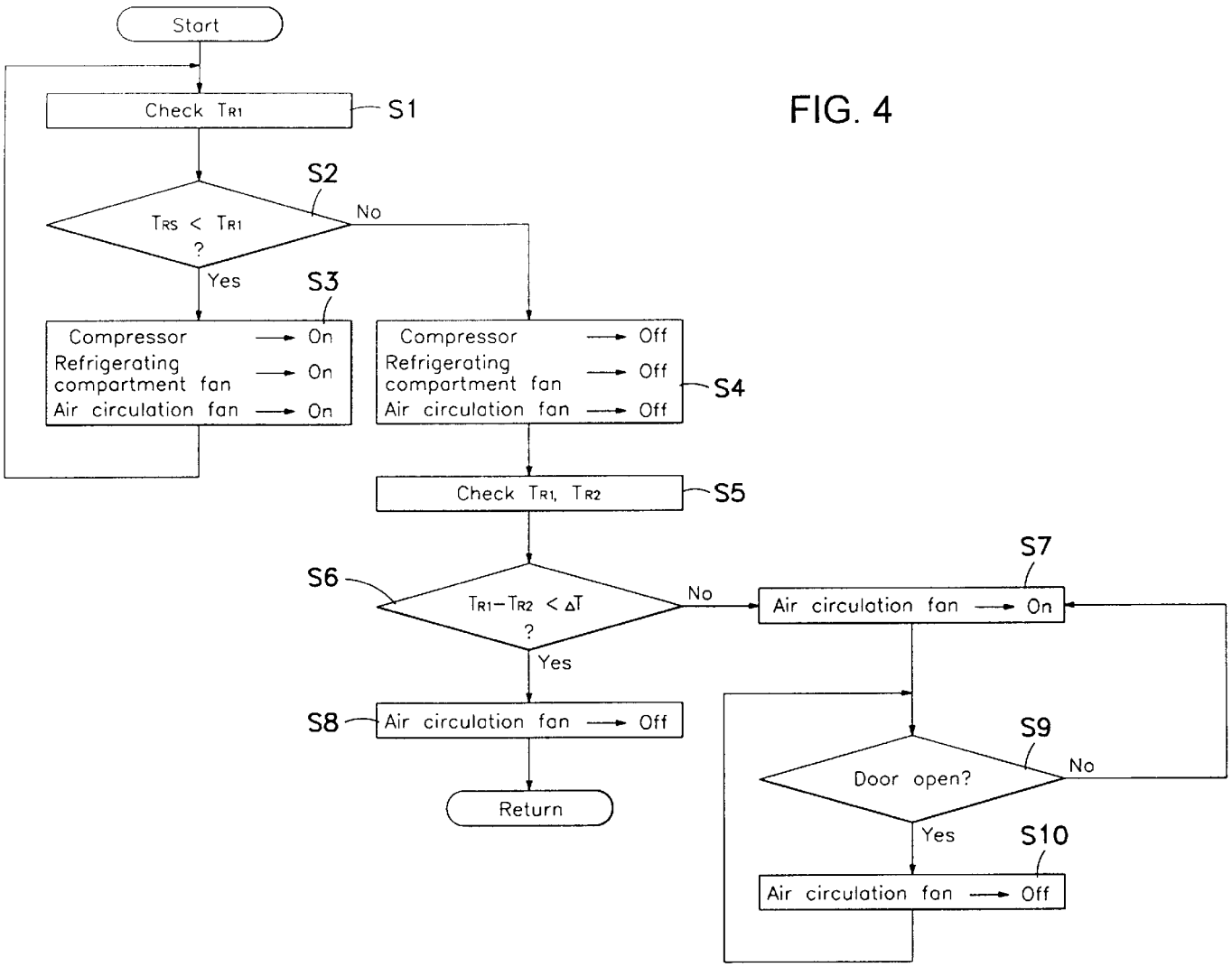
FIG. 4 shows a uniform cooling control method of a refrigerator in accordance with a preferred embodiment of the present invention.

FIG. 4 shows a uniform cooling control method of a refrigerator in accordance with a preferred embodiment of the present invention.

Referring to FIG. 4, the control part 100*a* senses (S1) a first temperature TR1 of the refrigerating compartment 120 by using the first temperature sensor 141, compares (S2) the first temperature TR1 with a predetermined set temperature TRS of the refrigerating compartment in order to determine whether or not a cooling operation about the refrigerating compartment 120 is performed.

If the first temperature TR1 is higher than the set temperature TRS in the step S2, the control part 100*a* determines a cooling operation of the refrigerating compartment 120, and turns on (S3) the compressor 130, the refrigerating compartment fan 124, and the air circulation fan 140 by using each driving parts 130*a,* 124*a* and 140*a,* thereby dropping a temperature of a refrigerating compartment 120. At this time, since the air circulation fan 140 and the refrigerating compartment fan 124 are driven at the same time, a cooling speed about the refrigerating compartment 120 becomes faster.

On the contrary, if the first temperature TR1 is lower than the set temperature TRS in the step (S2), the control part

100*a* turns off (S4) the compressor 130, the refrigerating compartment fan 124, and the air circulation fan 140 by using each driving parts 130*a*, 124*a* and 140*a*.

Thereafter, in order to determine whether or not the temperature of the refrigerating compartment 120 is uniformly cooled under the set temperature TRS, the control part 100*a* continuously senses (S5) a first temperature TR1 and a second temperature TR2 by using the first temperature sensor 141 and the second temperature sensor 142.

After sensing (S5) the first temperature TR1 and the second temperature TR2, the control part 100*a* calculates a temperature deviation on the basis of the first and second temperatures TR1 and TR2, and determines (S6) whether or not the calculated temperature deviation is beyond a predetermined temperature deviation ΔT.

If the temperature deviation is lower than the predetermined temperature deviation ΔT in the step S6, the control part 100*a* determines that the refrigerating compartment temperature is at a uniform condition, maintains (S8) an off state of the air circulation fan 140, and returns to the initial step S1.

However, if the temperature deviation is higher than the predetermined temperature deviation ΔT in the step S6, the control part 100*a* determines that the refrigerating compartment temperature is at a non-uniform state, turns on (S7) the air circulating fan 140, and thus makes a cool air be uniformly distributed in the refrigerating compartment 120.

While turning on the air circulation fan 140 in the step S7, the control part 100*a* determines (S9) whether the refrigerating compartment door 121 is opened by using the door opening/closing sensing part 127. If it is determined that the door 121 is opened in the step S9, the control part 100*a* turns off (S10) the air circulation fan 140 by using an air circulation fan driving part 140*a* in order to reduce a quantity of the cool air to be discharged to the outside. After that, if the user closes the door 121, the air circulation fan 140 is driven again.

Another uniform cooling control method in accordance with another preferred embodiment of the present invention will now be described with reference to FIG. 5.

Figure 5:
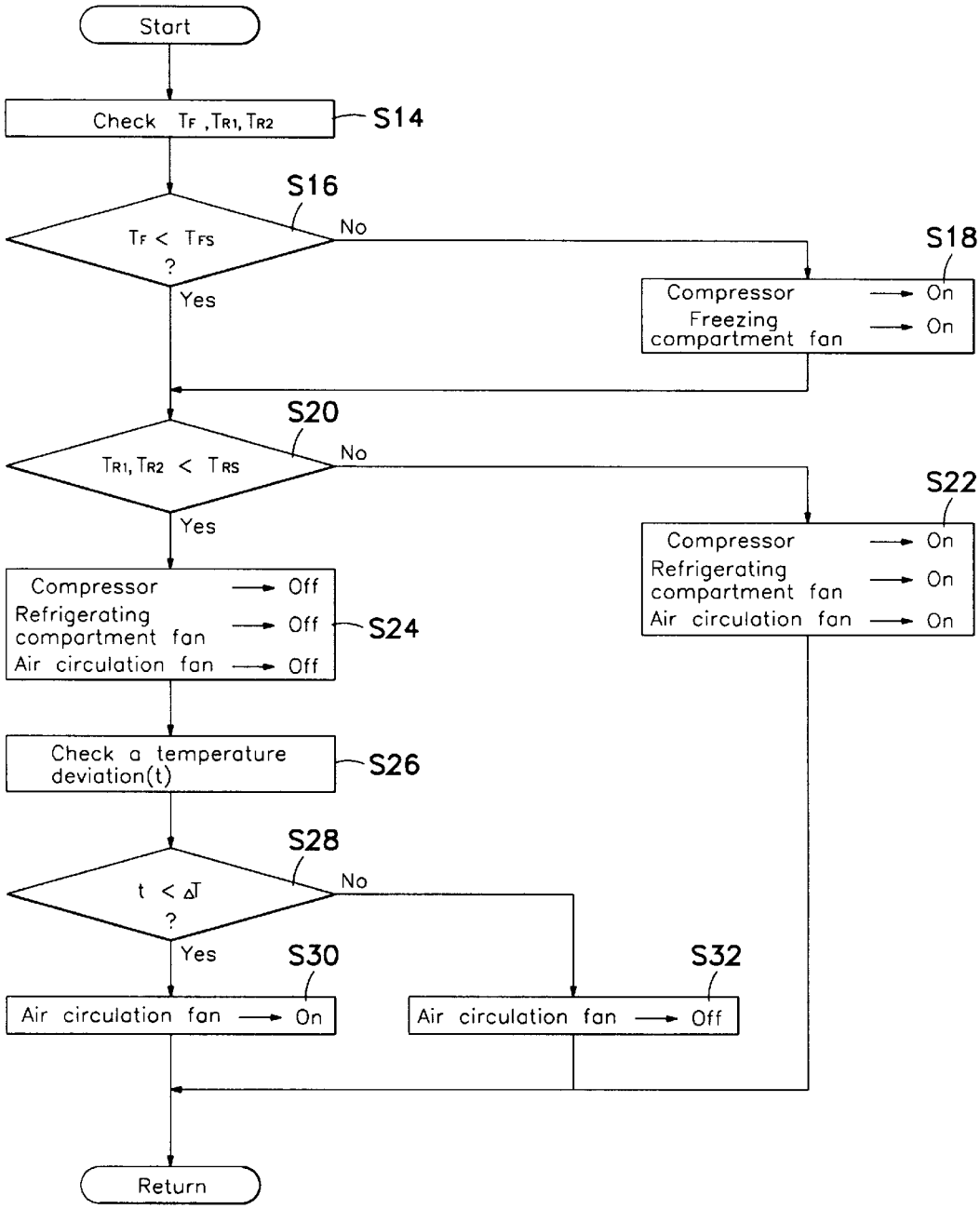
FIG. 5 shows a uniform cooling control method of a refrigerator in accordance with another preferred embodiment of the present invention.

FIG. 5 shows a uniform cooling control method of a refrigerator in accordance with another preferred embodiment of the present invention.

Referring to FIG. 5, the control part 100*a* senses (S14) a temperature TF of the freezing compartment 110 by using a temperature sensor 115, a first temperature TR1 of the refrigerating compartment 120 by using a first temperature sensor 141, and a second temperature TR2 of the refrigerating compartment 120 by using a second temperature sensor 142.

If the temperature TF of the freezing compartment 110 sensed in the step S14 is higher than the set temperature TFS of the freezing compartment 110 in the step (S16), the control part 100*a* performs (S18) a cooling operation about the freezing compartment 110 by turning on the compressor 130 and the freezing compartment fan 114 until the freezing compartment temperature TF becomes below the freezing compartment set temperature TFS.

However, if the freezing compartment temperature TF sensed in the step S14 is lower than the freezing compartment set temperature TFS in the step (S16), the control part 100*a* determines that the cooling operation about the freezing compartment 110 is not needed, and determines (S20) whether or not an average temperature value of the refrigerating compartment temperatures TR1 and TR2 sensed in the step S14 is lower than the set temperature TRS of the refrigerating compartment 120.

If the average temperature value is higher than the refrigerating compartment set temperature TRS in the step S20, the control part 100*a* performs a cooling operation about the refrigerating compartment 120 by turning on the compressor 130, the refrigerating compartment fan 124 and the air circulation fan 140.

On the contrary, if the average temperature value of the refrigerating compartment temperatures TR1 and TR2 is lower than the refrigerating compartment set temperature TRS, the control part 100*a* determines that the cooling operation about the refrigerating compartment 120 is not needed, and turns off (S24) the compressor 130, the refrigerating compartment fan 124 and the air circulation fan 140.

After that, in order to that the temperature of the refrigerating compartment 120 is uniformly distributed or not, the control part 100*a* calculates (S26) a temperature deviation t between the first temperature TR1 and the second temperature TR2, compares (S28) the temperature deviation t with a predetermined temperature deviation ΔT. If the temperature deviation t is higher than the predetermined temperature deviation ΔT in the step S28, the control part 100*a* determines that the temperature distribution is not uniform, turns on (S30) the air circulation fan 140, and thus makes a uniform cool air in the refrigerating compartment 120.

In the meantime, if the temperature deviation t is lower than the predetermined temperature deviation ΔT in the step S28, the control part 100*a* determines that a temperature deviation state of the refrigerating compartment 120 is relatively uniform, and maintains (S32) an off-state of the air circulation fan 140.

In FIGS. 4–5, the first and second temperature sensors 141 and 142 mounted into the refrigerating compartment 120 can be mounted to various parts excepting the upper and lower parts of the refrigerating compartment 120.

As described above, the present invention mounts an air circulation fan in addition to a prior refrigerating compartment fan into the refrigerating compartment, simultaneously drives the air circulation fan during a cooling operation about the refrigerating compartment, and quickly cools the inner space of the refrigerating compartment. In addition, when a cooling operation about the refrigerating compartment is not performed, the present invention detects a plurality of temperatures by using a plurality of temperature sensors mounted into the refrigerating compartment, drives an air circulation fan if there is a predetermined temperature deviation in temperatures sensed by the plurality of temperature sensors, and thus uniformly cools a refrigerating compartment temperature. As a result, the food can be stored at an optimum storage temperature.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art which this invention pertains.

What is claimed is:

1. In a refrigerator including: a refrigerating compartment, a compressor for compressing a refrigerant, a refrigerating compartment evaporator for generating a cool air, a refrigerating compartment fan for discharging the cool air into the refrigerating compartment, a door of th e refrigerating compartment, and a door opening/closing sensor for sensing an opening/closing of the door, a uniform cooling apparatus for the refrigerator comprising:

a plurality of temperature sensors which are mounted to at least two positions inside of the refrigerating compartment in order to sense a temperature deviation of the refrigerating compartment; and an air circulation fan which is additionally mounted to the refrigerating compartment, is separated from the refrigerating compartment fan, is turned on if a deviation among temperatures sensed by the plurality of temperature sensors is higher than a predetermined temperature deviation, is turned off if a deviation among temperatures sensed by the plurality of temperature sensors is lower than the predetermined temperature deviation, and makes a uniform cool air in the refrigerating compartment.

2. The uniform cooling apparatus according to claim 1, wherein the air circulation fan is mounted to a center part of a rear wall of the refrigerating compartment.

3. In a refrigerator including: a refrigerating compartment, a compressor for compressing a refrigerant, a refrigerating compartment evaporator for generating a cool air, a refrigerating compartment fan for discharging the cool air into the refrigerating compartment, a plurality of temperature sensors for sensing a plurality of refrigerating compartment temperatures, an air circulation fan which is mounted to a rear wall of the refrigerating compartment, and circulates a cool air, a door of the refrigerating compartment, and a door opening/closing sensor for sensing an opening/closing of the door, a uniform cooling control method for the refrigerator comprising the steps of:

(a) sensing a refrigerating compartment temperature by using the plurality of temperature sensors;

(b) calculating a temperature deviation among the refrigerating, compartment temperatures sensed in the step (a); and (c) driving the air circulation fan if the temperature deviation is higher than a predetermined temperature deviation, and uniformly cooling the refrigerating compartment.

4. The uniform cooling control method according to claim 3, further comprising the step of: turning off the air circulation fan if the refrigerating compartment door is opened during the step (c).

5. The uniform cooling control method according to claim 3, further comprising the step of: increasing a cooling speed of the refrigerating compartment by simultaneously driving the air circulation fan in addition to the refrigerating compartment fan if the refrigerating compartment temperature sensed in the step (a) is higher than a refrigerating compartment set temperature.

6. The uniform cooling control method according to claim 3, wherein the step (b) is performed after the refrigerating compartment satisfaction state that the refrigerating compartment temperature sensed in the step (a) is lower than a refrigerating compartment set temperature.

* * * * *